US006122869A

United States Patent [19]

Richardson

[11] Patent Number: 6,122,869

[45] Date of Patent: Sep. 26, 2000

[54] COMPOSITE DOOR AND FRAME

[75] Inventor: Richard J. Richardson, Simi Valley, Calif.

[73] Assignee: Anthony, Inc., San Fernando, Calif.

[21] Appl. No.: 08/938,593

[22] Filed: Sep. 26, 1997

Related U.S. Application Data

[63] Continuation of application No. 08/543,043, Oct. 13, 1995, abandoned, which is a continuation-in-part of application No. 08/237,958, May 3, 1994, which is a continuation of application No. 07/849,900, Mar. 12, 1992, Pat. No. 5,363, 611.

[51] Int. Cl.[7] ..... E06B 1/14

[52] U.S. Cl. ..... 52/204.7; 52/656.4; 52/656.6; 52/656.1; 52/204.705

[58] Field of Search ..... 52/656.1, 656.4, 52/656.6, 204.7, 204.705, 204.595, 204.593; 312/138.1, 140, 296

[56] References Cited

U.S. PATENT DOCUMENTS

| | | | |
|---|---|---|---|
| 3,866,373 | 2/1975 | Hudock . | |
| 3,924,373 | 12/1975 | Lizdas et al. | 52/213 |
| 3,949,526 | 4/1976 | Sherlock et al. . | |
| 4,024,690 | 5/1977 | Collins et al. | 52/397 |
| 4,290,233 | 9/1981 | Hubbard | 52/207 |
| 4,588,235 | 5/1986 | Barroero . | |
| 4,821,476 | 4/1989 | Thoburn et al. | 52/204.595 |
| 4,924,631 | 5/1990 | Davies et al. . | |
| 4,999,958 | 3/1991 | Harrison | 52/204.595 |
| 5,035,085 | 7/1991 | Mamelson et al. . | |
| 5,099,624 | 3/1992 | Valentin | 52/207 |
| 5,199,234 | 4/1993 | Guhl . | |
| 5,212,921 | 5/1993 | Unruh . | |
| 5,280,686 | 1/1994 | Davies . | |
| 5,290,611 | 3/1994 | Taylor . | |
| 5,371,987 | 12/1994 | Hirsch et al. | 52/207 |
| 5,435,106 | 7/1995 | Garries et al. . | |
| 5,448,869 | 9/1995 | Unruh et al. | 52/656.1 |

*Primary Examiner*—Carl D. Friedman
*Assistant Examiner*—Phi Dieu Tran A
*Attorney, Agent, or Firm*—Henricks, Slavin & Holmes, LLP

[57] ABSTRACT

A swing door is described having a door frame, hinge assembly, transparent panels supported by the door frame and a glazing strip surrounding the panel edges. The door frame is formed from pultruded rail elements wherein each rail element is defined by a rail profile including a channel for accepting the panel and forming seal with the glazing strip. The channel has a base defined by a first wall in the profile and the profile further includes second, third and fourth continuous walls having outside surfaces and defining with the first wall and enclosure adjacent to channel for receiving the hinge assembly and wherein the outside surfaces are substantially free of projections from their surfaces. A frame assembly for supporting such a door includes a pultruded frame rail element having a first leg and a second leg integral with each other and wherein each of the first and second legs have respective thicknesses and wherein each leg includes at least one internal wall defining a fully enclosed void within the thickness of the leg.

27 Claims, 8 Drawing Sheets

22
116
203
22
203A
250
38
104
36
22
22
114
223
26
40
250
203A
203

COMPOSITE DOOR AND FRAME

CROSS-REFERENCE TO RELATED APPLICATIONS

This application is a continuation of Ser. No. 08/543,043 filed Oct. 13, 1995, now abandoned, which is a continuation-in-part of Ser. No. 08/237,958, filed May 3, 1994, which is in turn a continuation of Ser. No. 07/849,900 filed Mar. 12, 1992, now U.S. Pat. No. 5,363,611, issued Nov. 15, 1994.

BACKGROUND OF THE INVENTION

1. Field of the Invention

The present invention relates to refrigerator display case doors and frames, and more particularly to refrigerator display case doors and frames formed from composite materials which may allow a door and frame to have better thermal, structural and appearance characteristics.

2. Related Art

Commercial refrigerators and refrigerator display cases are used in markets, food-vending operations, liquor stores and the like for the simultaneous preservation of freshness and attractive display of foods to the customer. Typically, commercial display cases have frames defining an opening for the case which is accessed through large, swinging doors having large areas of multi-layered glazing to permit the customer to see, select and access the refrigerated product easily, while preventing heat transfer into the refrigerated space. Typically, a metal door rail supports and surrounds the multi-layered glazing to support the glazing panels and to protect the edges thereof.

Present commercial glass refrigerator doors typically have door rails which extend peripherally around the glass panels of the doors. Such door rails are used to hold the glass panels in place and extend peripherally around both the inside and outside glass surfaces of the doors.

Door rails have heretofore been formed from extruded or other forms of metal rail elements fastened together at mitered corners of upper and lower horizontal rail members and left and right vertical side members. The hardware for connecting the corners of the rail structures can be complicated, with a significant number of interfitting parts to provide a suitable corner connection. Hinge elements support the door for pivotable movement relative to a vertical axis.

Conventional commercial refrigerated display cases typically also include surrounding frames for defining the opening in the case or unit within which the product is displayed, and which supports the refrigerator doors. The surrounding frame is typically assembled from frame rails typically formed from aluminum components having a decorator strip, extending over the front of the case, a side-wall extending inwardly relative to the case from the decorator strip, the side-walls of the top and bottom rails supporting the hinges for the doors, and a transverse wall for mounting a contact plate against which the magnetic gasket on the door seals. The transverse wall also forms a support for mullions in the display case which contain wiring, ballasts or other hardware for operating lighting units mounted on the surfaces of the mullion extending into the display case. The rearwardly facing portions of the transverse walls also may support raceways or other hardware for equipment used in the unit. The hardware on the rearwardly facing surfaces of the frame are typically difficult to access for servicing, and typically require additional time for assembly, such as for turning an assembled frame over in order to access or assemble the raceways, the mullion elements, and the like.

Frame rails have typically been formed from extruded or other forms of metal fastened together at mitered corners. Such metal rail members may provide an aesthetically pleasing appearance, but are limited in terms of color and texture. While extruded aluminum elements may be formed with different profiles, a large number of frame profiles would require a significantly larger inventory.

The metal frame and door rail members, while providing suitable structural support and pleasing aesthetic appearance, readily conduct heat from outside the refrigerated display case, as well as serving as a condensation surface for water vapor which may be present in the ambient air. To eliminate condensation and fogging, heater wires are sometimes placed in the rail to warm the metal rail and to thus inhibit condensation especially in freezer cases. To change the aesthetic appearance, some rails have been redesigned to place a substantial amount of the metal rail behind the front panel, but there still exists rail material that extends over the front glazing panel.

Combination doors have been made which include metal and plastic, but such doors are typically expensive to manufacture and may include incompatible materials, especially in terms of expansion and contraction rates, and the like. Door and frames have been formed from pultruded materials, but the resulting doors or frames have not been entirely satisfactory. In some situations, covers are still required for the pultruded material to provide an aesthetically pleasing appearance.

SUMMARY OF THE INVENTION

An invention is disclosed which provides better thermal characteristics, higher structural rigidity, strength and integrity, improved appearance, lighter weight and improved manufacturing efficiencies for door rails, frame rails and mullions, as well as other components of refrigerated display cases. In one form of the invention, a swing display door includes pultruded rail elements wherein each rail element is defined by a profile having a channel for accepting one or more panels and forming a seal therewith. The profile also includes four sides defining a hollow or void wherein one of the walls defines the base or bottom of the channel. Preferrably, the outer surfaces of the three sides, other than the one forming the channel, are substantially free of projections to provide a uniform-appearing outer surface, and to reduce the surface area of the door rail.

In an additional form of the invention, a frame assembly includes frame rails formed by pultrusion having first and second legs integral with each other wherein each of the first and second legs have respective thicknesses and wherein each leg includes at least one void within the thickness of the leg. The presence of a void provides improved thermal characteristics, provides a single surface for attachment of hardware, without passing completely through the leg, thereby reducing thermal transfer, and provides lighter weight in the part.

In a preferred form of the frame rail, the voids have a greater length than width, in cross section, and for example, may be substantially oval. The width of the void may be substantially less than 0.100 inches.

In another form of the invention, a frame has first and second legs and one of the legs of the frame, such as that against which the door of a display case seals upon closure, is formed in a U-channel arrangement. The U-channel is closed by a removable contact plate. The contact plate is removable to permit installation and servicing of hardware, such as ballast systems, wiring, and the like. As such, the forwardly facing U-channel provides a raceway which makes assembly of the surrounding frame much easier, and improves service-ability for the frame and the hardware inside the U-channel. Each wall of each leg may include a void.

The various features of the present invention will be best understood by reference to the following description of the preferred embodiments taken in conjunction with the accompanying drawings.

DESCRIPTION OF THE PREFERRED EMBODIMENTS

The following description taken in conjunction with the drawings sets forth preferred embodiments of the present invention. The embodiments disclosed are the best modes contemplated for carrying out the invention in a commercial environment, though it should be understood that various modifications can be accomplished within the parameters of the present invention.

Various embodiments of the present inventions are disclosed which provide improved thermal characteristics in door and frame rails and which reduce or eliminate the requirement of supplemental heat in such door and frame rails. The embodiments also provide improved structural characteristics including high structural rigidity, strength and integrity, improved appearance, light weight structures and improvements in manufacturing efficiencies. The inventions also provide a more easily accessible structure for hardware, wiring, and the like.

Figure 1:
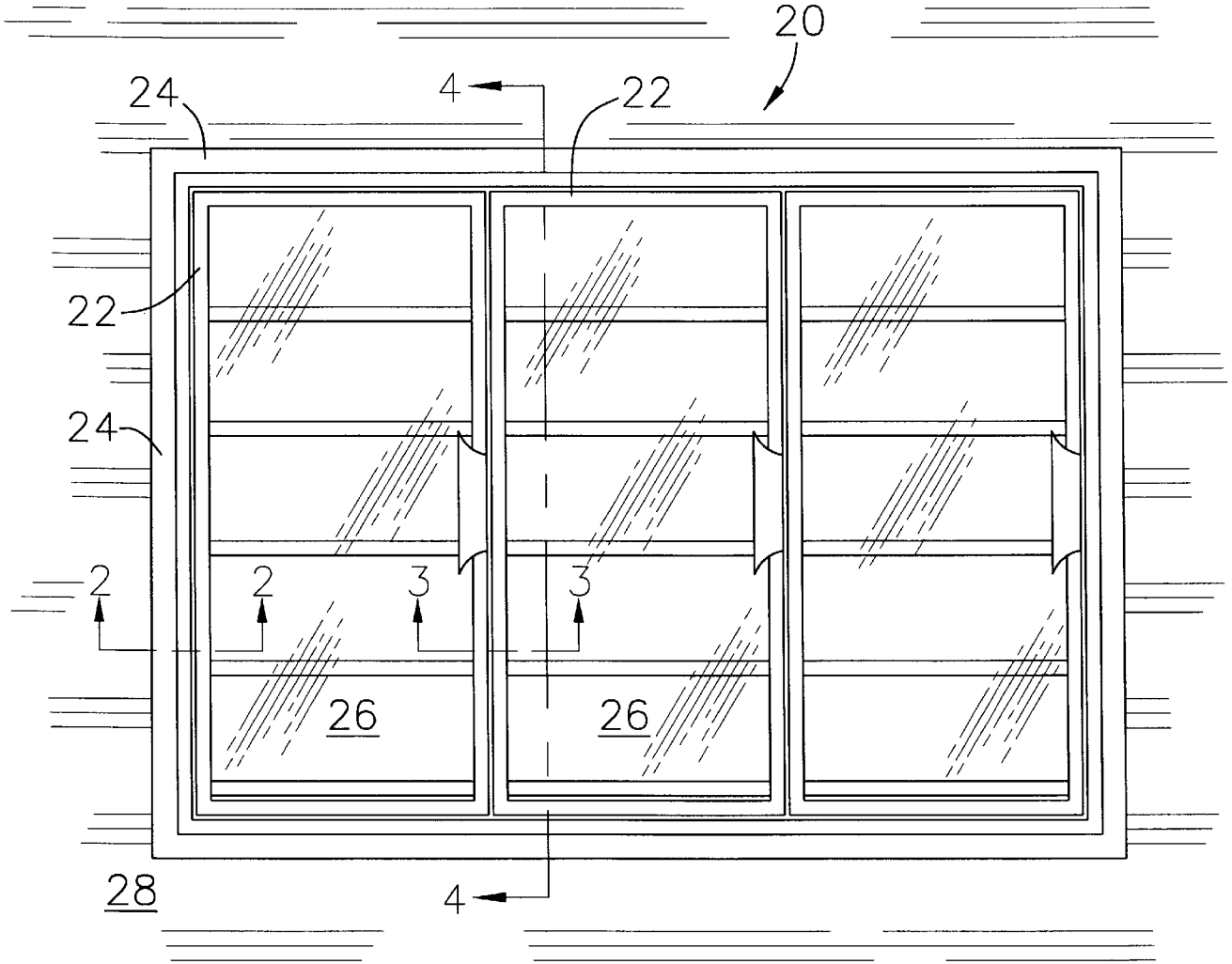
FIG. 1 is an elevational view of a display case with which the present invention may be used, having doors mounted thereon and shelves mounted inside the display case.

In one preferred embodiment of the invention, the door and frame rail elements may be used with a display case 20, having doors 22 mounted in the surrounding frame 24. The doors 22 have glass panels 26 to allow someone, such as a customer in a supermarket, to look through the glass panels 26 at items 28 (FIG. 1). For more information about display case systems, see published PCT Application, Publication No. WO95/16375, the text and drawings of which are incorporated herein by reference. The display case may be mounted in a wall, or may be a free standing unit, or may take any other appropriate configuration. The wall or sides of the opening defining the opening, or other frame members thereof are generally designated at 28. Typically, the surrounding frame 24 sets into the opening defined by the wall of the room, by the top, bottom and sides of a free-standing unit, or the like.

The door 22 preferrably includes four mitered door rail elements 30 (FIG. 2) assembled into a rectangular door frame holding or otherwise supporting the panels 26. In the embodiments shown in FIG. 2, the panels 26 are a glass sealed pack of three glass panes separated by spacers, as is known to those skilled in the art. The glass pack may be formed and assembled in any number of ways for use in the door 22. For example, a glazing strip 32 made from conventional material may be installed around the edges of the sealed glass pack for sealing the glass pack in the door rails. The glazing strip is preferrably U-shaped with a square inside base and a square outside base, and an outwardly projecting lip 34 at each free end of the U-channel shape. The outward projections forming the two lips help to seal the glass pack in the door rail elements.

Figure 5:
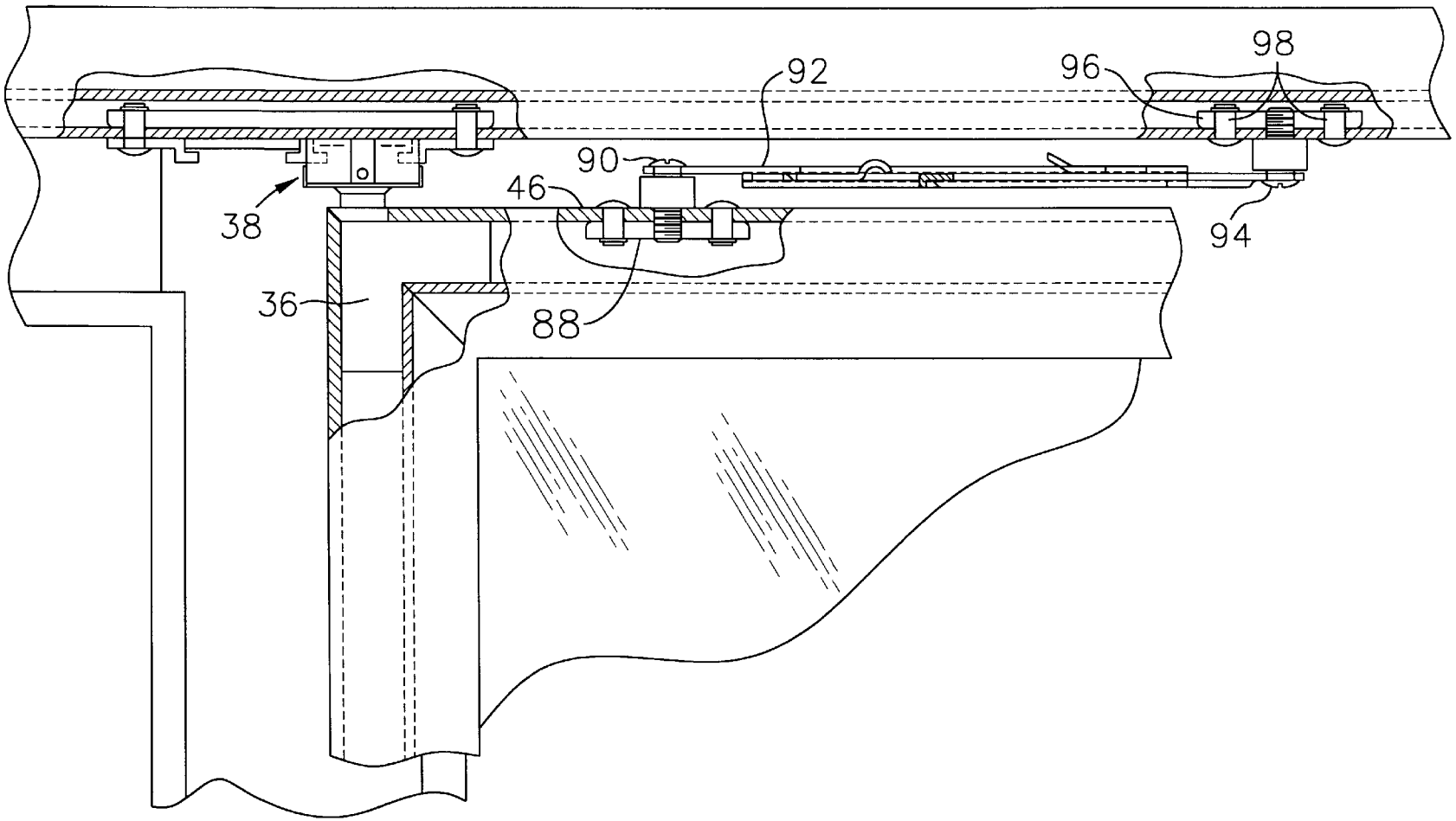
FIG. 5 is an elevation view and partial cut-away of a frame and door assembly showing attachment of hardware.

The individual door rail elements are joined at their respective corners by corner key elements 36 (FIG. 5). The corner key elements may be formed in a number of ways, but are preferrably formed of a light weight material compatible with the pultruded door rail elements. The corner keys on the hinge side of the door are formed so as to accept hinge elements 38 which may have the form and structure of the hinge and connector element and/or the door closure element shown in U.S. Pat. Nos. 4,671,582 and 4,696,078.

The door also preferrably includes a sealing gasket 40 (FIGS. 2 and 3) and can be any conventional sealing gasket known to those skilled in the art. The sealing gasket is mounted on or to the inside face of the door rail elements, such as in a gasket groove 42, described more fully below. One preferred sealing gasket shown includes an additional amount of material adjacent the magnetic strip to increase thermal insulation.

The door rail element 30 has the profile shown in FIGS. 2–4 and 9, and includes a forward face 44, (FIG. 9) a side-face 46, a rearward face 48, a U-channel 50 for accepting the glass pack, and a full hollow 52 for accepting the corner keys, fastening elements for hardware, and the like. The full hollow 52 is defined by the inside surfaces of the forward face 44, the side-face 46, the rearward face 48, and the interior wall 53, running parallel to the side face 46 and extending between the forward face 44 and the rearward face 48. The interior wall 53 forms the base of the U-channel 50 and constitutes a backing wall against which the glazing strip is pressed.

The forward face of the door rail element is substantially flat and straight except for the front corner 54 which is substantially radiused, and a feathered lip 56, whose thickness between the outside and inside decreases gradually to forward tip 58. Forward tip 58 is also radiused. The forward face of the door rail element combined with the other rail elements in the frame, produce a relatively flat front face and the appearance, at a distance, of a door which has the forward face of the door rail element flush with the glass. The amount of the forward face of the door rail element which extends over the glass is also minimal.

Forward tip 58 curves into a forward bite surface 60 extending from the tip 58 to an edge 62 for firmly holding the glazing strip 32, and therefore the glass pack 26. The forward bite surface 60 is raised relative to the parallel inside surface 64 of the U-channel. The parallel inside surface 64 joins the interior wall 53 to form part of the U-channel. The interior wall 53 also joins an inside surface 66 parallel to the inside surface 64. Inside surface 66 terminates at a projection 68 which extends forwardly from the inside surface 66 to form a rearward bite surface 70 serving substantially the same function as the forward bite surface 60. The projection 68 diverges from the inside surface 66 to the rearward bite surface 70 to provide a larger surface area for contacting the glazing strip.

Rearward bite surface 70 terminates at edge 72, the other side of which is connected to an inwardly facing surface 74 which extends rearwardly to inner corner 76 which curves to the rearward face 48. The rearward face 48 is substantially flat and straight between the inner-corner 76 and the rearward corner 78 except for the gasket groove 42. The gasket groove 42 is substantially oval except for the opening defined by the shoulders 80.

The side face 46 between the rearward corner 78 and the forward corner 54 is substantially flat and straight.

The full hollow 52 includes two forward corners 82 and two rearward corners 84. The inward forward corner, adjacent the U-channel, has a smaller radius than the other three corners, which are substantially the same, in the preferred embodiment. The full hollow 52 also includes a ridge 86 which extends inward in the interior of the full hollow to properly position such hardware as corner keys, and is substantially centered between the two rearward inner-corners 84.

A handle is mounted to the handle side of the door rail by fasteners countersunk through side face 46 of a door rail and threaded into a mounting plate of the door handle placed flush against the inside or interior surface of side face 46. The handle is mounted by passing the handle mounting plate, having tapped holes, through a slot formed through the forward face 44 adjacent corner 54 so that the mounting plate of the handle can pass through the slot and rest flush against the interior or inside surface of side face 46. An exemplary handle may be such as is used on a preexisting door such as the Model 2100 door manufactured by Anthony's Manufacturing Company, Inc.

The door rails are assembled with a glass unit and glazing strips in a manner conventional to mitered aluminum rail doors. Three sides are assembled with corner keys and the fourth side is assembled onto the glass and adjacent two sides for final assembly and sealing. The hardware is then installed, including the hinge pin 38 into the corner key and the torque mechanism into its corresponding corner key. A fastening plate 88 (FIG. 5) is pre-installed on the upper door rail and held in place by blind fasteners such as blind rivets and accepts a door hold open fastener 90. The door hold open fastener anchors one end of a door hold open 92, the other end of which is mounted to the door frame through a fastener 94 to a frame mounting plate 96, which in turn is held in place by blind fasteners 98. It should be noted that the door hold open fastening plate 88 sandwiches the side face 46 between the plate and the blind fasteners, and the mounting plate and fastener do not pass completely through the full hollow 52. Therefore, mounting and sealing of the glass pack within the door rails is not compromised by any adjacent hardware in the door.

Figure 2:
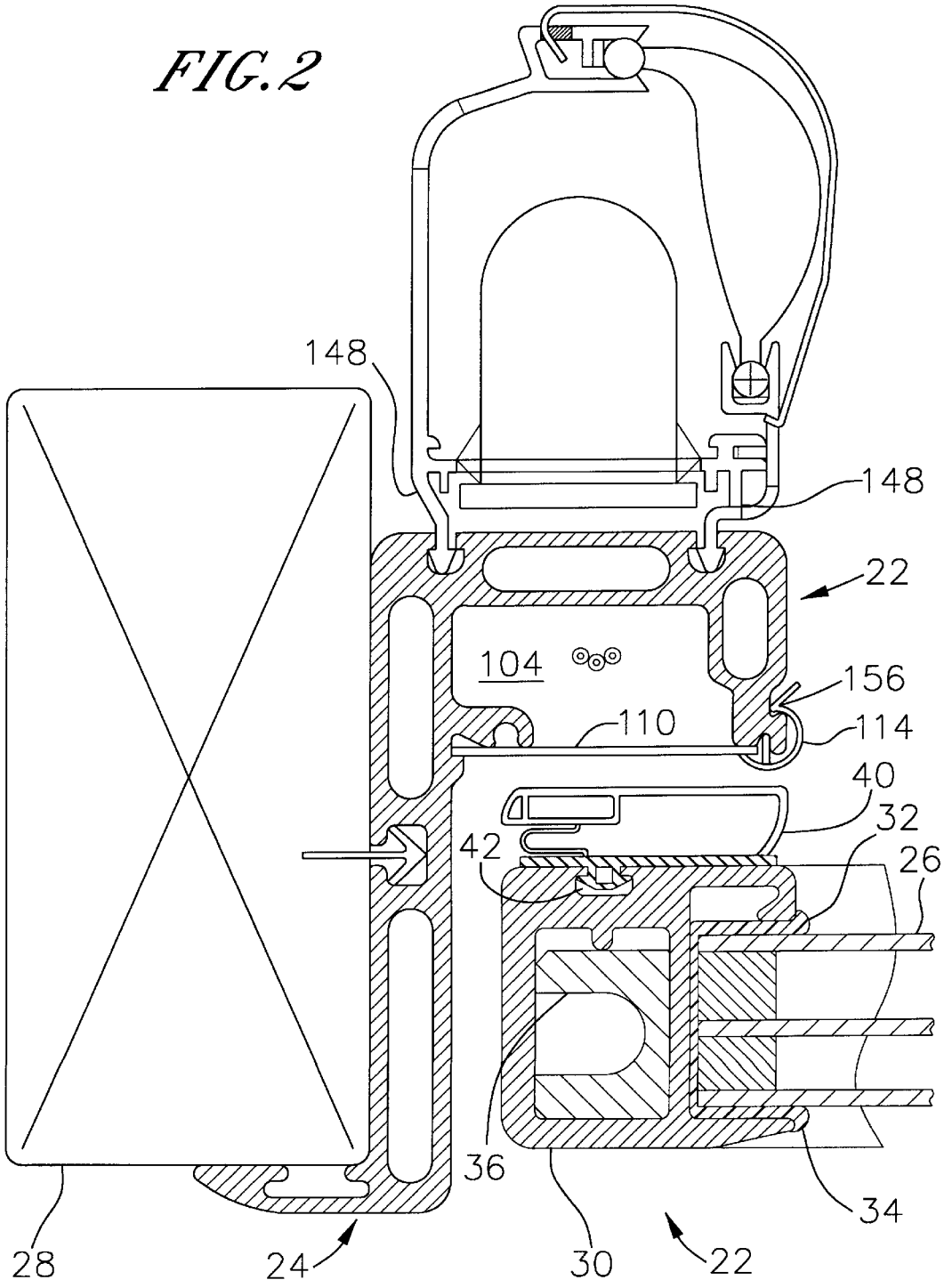
FIG. 2 is a cross sectional view taken a long lines 2—2 of FIG. 1 showing a partial cross section of a door and a cross section of an end frame element showing a frame rail profile and a door rail profile.
Figure 3:
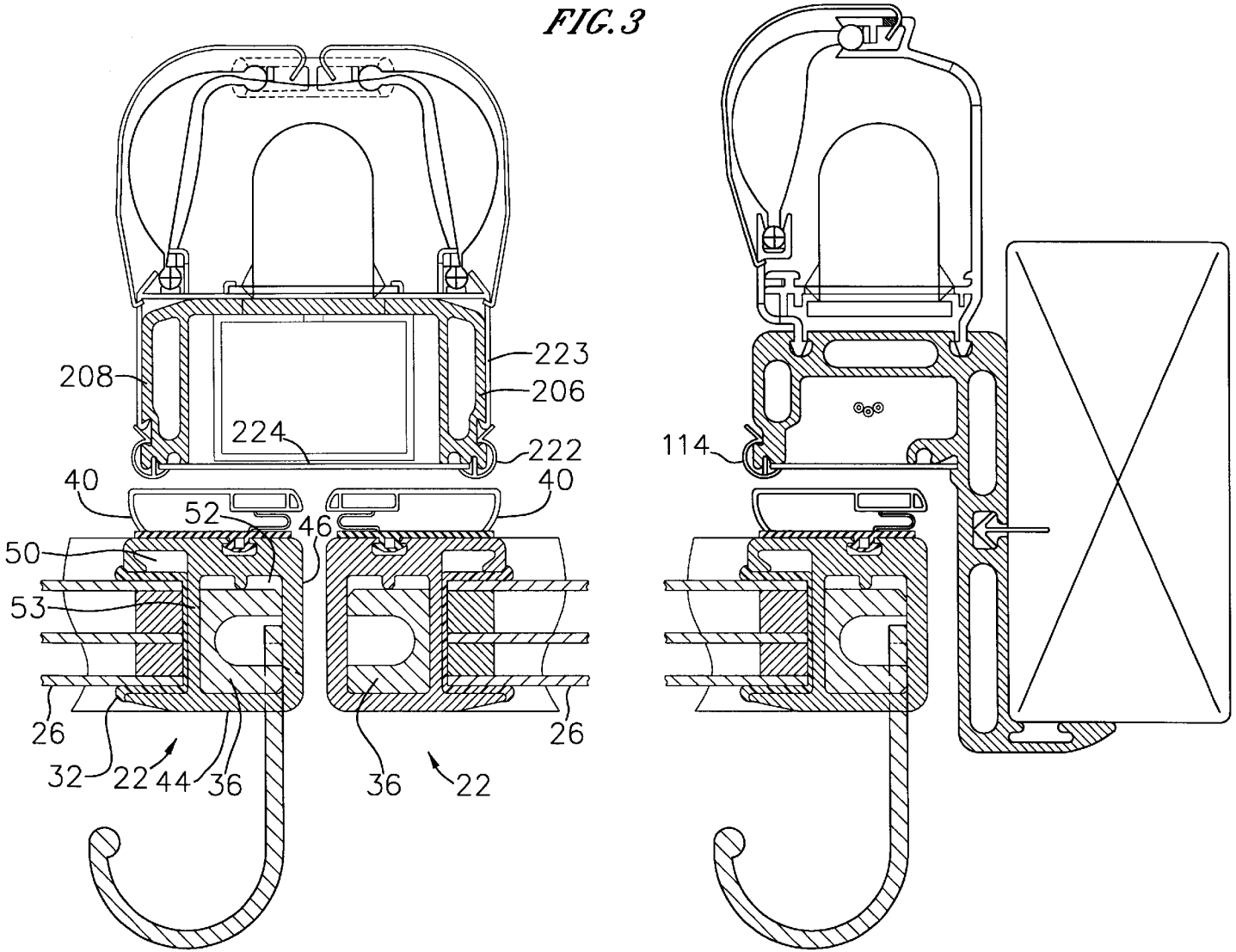
FIG. 3 is a cross sectional view of portions of adjacent doors and a center mullion taken a long lines 3—3 of FIG. 1 in accordance with further aspects of the present invention.
Figure 4:
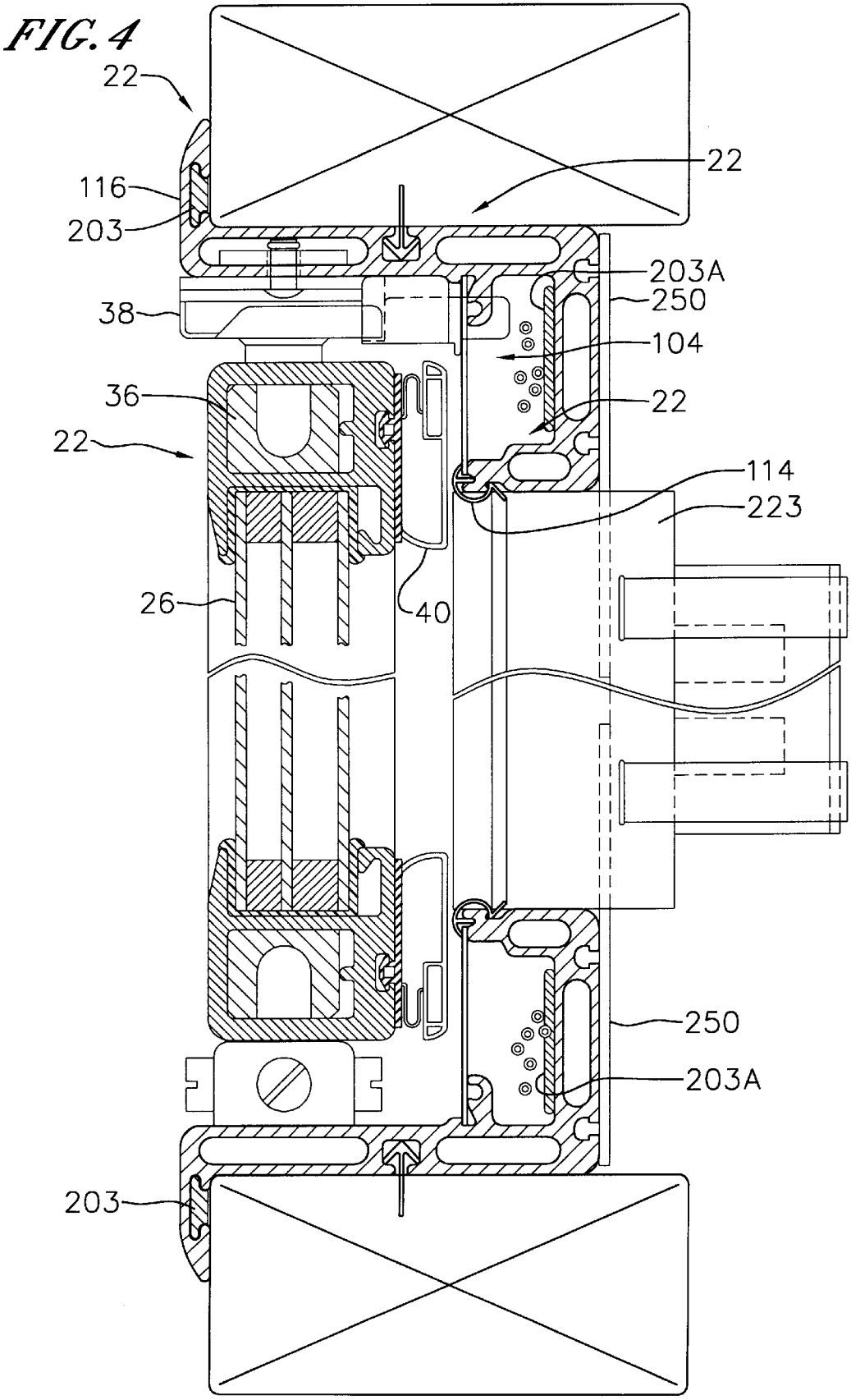
FIG. 4 is a vertical cross section and partial cut-away view of door and frame rail elements and showing a center mullion and attached lighting fixture, in accordance with further aspects of the present invention.
Figure 10:
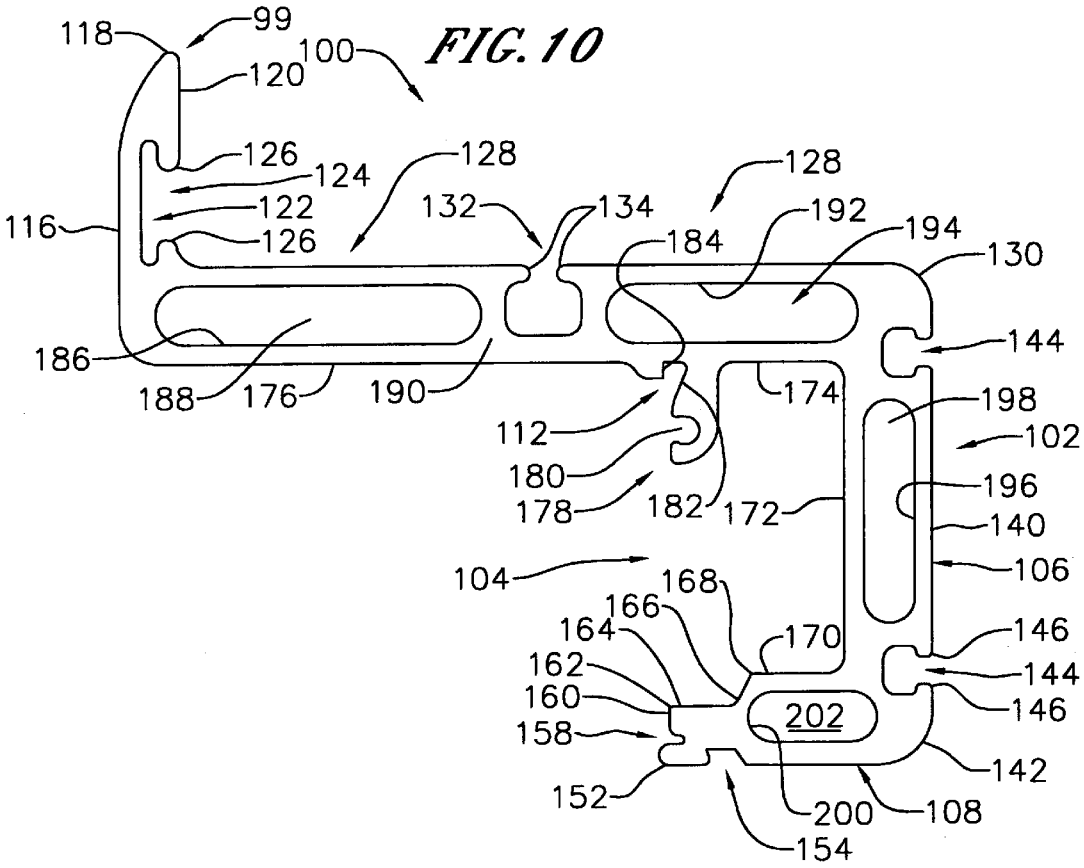
FIG. 10 is an end view substantially to scale of a frame rail profile in accordance with one aspect of the present invention.

The frame rail (FIGS. 2, 4, 5, 7 and 10) includes a decorator strip 99 (note FIG. 10) for covering the face of the wall of the case, a first leg or side-wall 100 for covering the exposed edge of the case wall and for extending into the case sufficiently to allow placement of the door in an inset or recessed fashion, and also for mounting various hardware for supporting the door. The sidewall 100 also serves in a preferred embodiment to form one wall of a recessed cavity or raceway 104, which will contain wiring, ballast equipment or other hardware. The second leg or transverse wall 102 forms the structural backstop for closing and sealing the door against the frame rail, and forms second and third sides 106 and 108, respectively, of the raceway 104. The fourth side of the raceway is formed by a removable contact plate 110 held in place by a captivating groove 112 and a zipper strip or contact plate clip 114 (FIG. 2).

The decorator strip 99 includes a straight flat decorator wall 116 which is feathered to a decorator tip 118. The rearward facing surface 120 of the decorator strip extends from the tip 118 to an insulation retaining groove 122, which is formed into the thickness of the decorator strip 99. The insulating retaining groove is formed as a semi-hollow oval 124, with the opening defined by rounded shoulders 126.

The outward facing surface 128 of the sidewall 100 is also substantially flat and straight and extends from the decorator strip 99 rearwardly to a radiused transverse wall corner 130. The surface 128 is substantially continuous except for an insulation retaining groove 132 having a rectangular cross sectional semi-hollow, the opening to which is defined by radiused shoulders 134.

The rearwardly facing surface 140 of the transverse wall 102 is substantially straight and flat from the radius corner 130 to the radius corner 142 between the second side of the raceway 106 and the third side of the raceway 108. The rearwardly facing surface 140 is substantially continuous except for a pair of spaced apart fixture retaining grooves 144 defined by substantially rectangular semi-hollows, the openings of which are defined by radiused shoulders 146. The grooves 144 accept and retain convergent engagement tips 148 (FIG. 2) for a light fixture 150 or other equipment.

The third side 108 of the raceway is also substantially flat and straight and extends from the radius corner 142 to a tip 152 which is enclosed by the contact plate retaining clip 114. A slanted groove 154 extends longitudinally of the frame rail adjacent tip 152 for accepting and retaining the angled engagement tip 156 of the retaining clip. The groove 154 is dimensioned in such a way as to retain the clip 114 in place during normal operation but still allow removal of the clip through the free end of the angled tip 156 by hand or by an appropriate tool for gaining access to the raceway 104.

The outwardly facing side of the tip 152 extends to a retainer clip centering groove 158 which accepts a centering ridge on the retaining clip for properly positioning the retainer clip. The other side of the groove 158 is formed by a backstop surface 160 against which the contact plate 110 is pressed by the retainer clip 114.

The backstop surface 160 extends to a radiused corner 162 defining the end of a first inside wall 164 of the raceway. The wall 164 terminates at a slanted shoulder 166, which helps to define a wall for a void, described more fully below in the frame rail. The slanted shoulder 166 terminates at a radiused corner 168 which also defines one end of a second inside raceway wall 170. The second raceway wall joins the third and raceway bottom wall 172 at a radiused corner joining the two walls. The bottom raceway wall 172 is substantially flat and straight, as is the first and second raceway walls 164 and 170, and joins the substantially straight and flat third raceway wall 174. The third raceway wall 174 would join and be continuous with an inside sidewall surface 176 but for a contact plate projection 178. The contact plate projection 178 forms the capture groove 112, as well as a backstop for the contact plate. The contact plate projection 178 may also include a heater wire groove 180 for raising the temperature of the contact plate, if necessary, to prevent condensation or ice formation such as in freezer applications.

The capture groove includes a slanted wall 182 for permitting insertion of one edge of the contact plate and a flat wall ridge 184 for retaining the edge of the contact plate. The contact plate projection can but need not be formed so as to bias the contact plate against the retaining clip 114. For example, dimensioning the contact plate projection 178 and the flat wall ridge 184 to provide a bias or slight deformation in the contact plate when the contact plate is in place with the retaining clip would serve several purposes. First, such bias or deformation would minimize the possibility of the contact plate moving relative to the frame, thereby reducing noise and any possible misalignment of the magnetic contact strip with the contact plate. Additionally, the possibility that air would pass around the contact plate is minimized, thereby minimizing the possibility of air flow between the raceway and the outside of the case. Additionally, if a heater wire was in place in the groove 180, the heater wire would also contact the contact plate and provide bias or slight deformation, when the contact plate is in place, to insure good contact between the heater wire and contact plate.

The inside sidewall surface 176 is substantially straight and flat from the contact plate projection 178 to the radiused corner joining the decorator face 116.

The frame rail, like the door rail, is a lineal piece and is pultruded in the conventional manner and cut to the desired length.

For each of the three decorator strip 99, sidewall 100 and transverse wall 102, the overall thickness of each wall is preferably uniform over the entire length of the walls, except for the projections or grooves formed therein for attachment or acceptance of external pieces. The thicknesses are preferably comparable to existing frame rail dimension so that substitution of the pultruded equipment can be easily made for existing equipment without redesign. Additionally, being a pultruded element, the frame rail with the grooves and projections discussed above is preferrably an integral unit and formed in a single pultrusion process.

In the preferred embodiment, a plurality of voids are formed within the thickness of the sidewall and transverse walls for providing thermal insulation, lighter parts, as well as secondary walls for attachment of hardware. The voids are preferrably formed within the thickness of the walls so that the outer surfaces of the walls can be substantially continuous and uniform, except for the grooves and projections formed for specific purposes, to thereby avoid discontinuities, improve manufacturing throughput and to minimize the number of discontinuities in the external surfaces of the rails. In the preferred embodiment, the frame rail (FIGS.2 and 10) includes an oval wall 186 defining a first void 188 within the thickness of the sidewall 100. The first void extends a substantial length of the sidewall 100 while leaving sufficient wall material 190 between the first void 188 and the insulation retaining groove 132. The sidewall includes a second oval wall 192 defining a second void 194 on the opposite side of insulation retaining groove 132 from the first void 188.

The second side of the raceway 106, of the transverse wall 102, includes a third oval wall 196 defining a third void 198 centered approximately midway between the fixture retaining grooves 144. A fourth oval wall 200 defines a fourth void 202 in the third side 108 of the raceway, also part of the transverse wall 102. These four voids improve the thermal characteristics of the frame rail, decrease the weight of the frame rail and provide a pair of opposite walls, either one of which can be used to mount hardware or other pieces without breaching the opposite wall, thereby minimizing the possibility of a direct thermal pathway between the cold and the warm sides of the frame.

The frame rails are assembled and held together using a plurality of corner keys, typically two for each corner. A first corner key 203 (FIG. 4) is driven into, retained in by interference fit and connects adjacent ovals 124 on the rear facing surfaces of the decorative strips. This corner key holds the frame rails together relative to one direction i.e., aligned across the front of the case so that the decorator strips are flush with the plane of the case front. A second corner key 203A is positioned in adjacent raceways 104 to hold the adjacent frame rails together relative to a second direction. The second corner key insures flush contact between adjacent mitered corners of the decorator strips, to minimize any gap there between. The second corner key is positioned in the bottoms of adjacent raceways against surfaces 172, and is fastened in place by blind fasteners or pop rivets passing through the wall 172 and into void 198. The pop rivets do not pass through the adjacent surface 140 but only through wall 172. Other suitable assembly and retaining arrangements can be made.

Upon assembly, sealant can be added to the mitered corners of the frame rails at those points internal or rearward of the contact plate to seal against air flow. Sealant may also be used in other areas, for example in conjunction with mullions or other components as desired, but additional sealant is not believed to be necessary.

Figure 11:
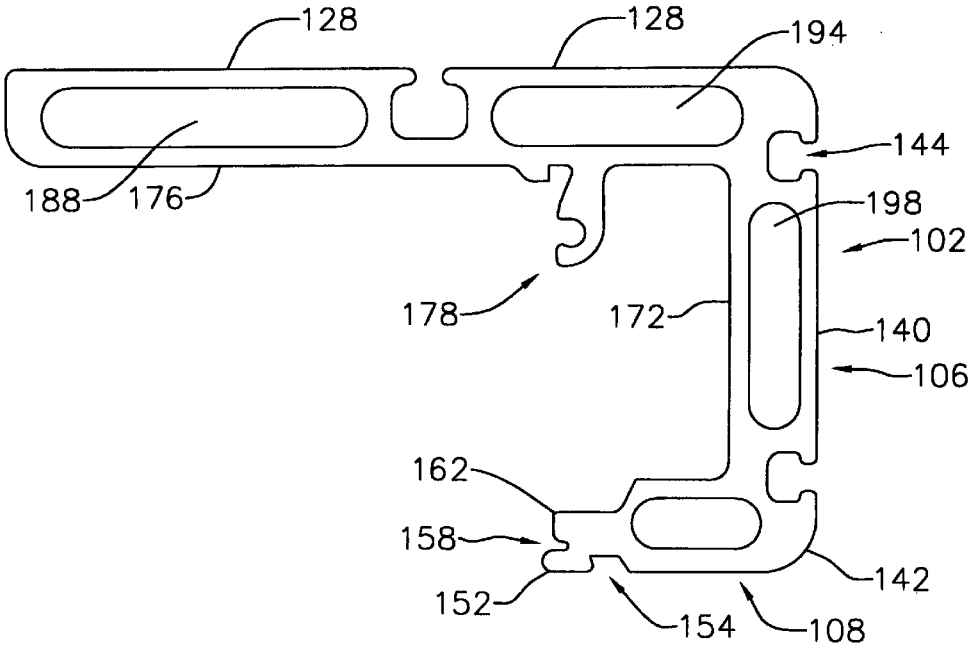
FIG. 11 is an end view substantially to scale of a profile of an end mullion frame element according to one aspect of the present invention.

The end mullion (FIG. 11) includes the same features as were described above with respect to the frame rail, except for the decorator strip 116. The structure and features of the frame rail are otherwise also included in the mullion, and will not be discussed further. The end mullion would be used as a frame element in what is known as a continouse line up arrangement of refrigeration units. However, the frame rail shown in FIG. 10 would generally still be used at the extreme ends of the display case as whole.

Figure 12:
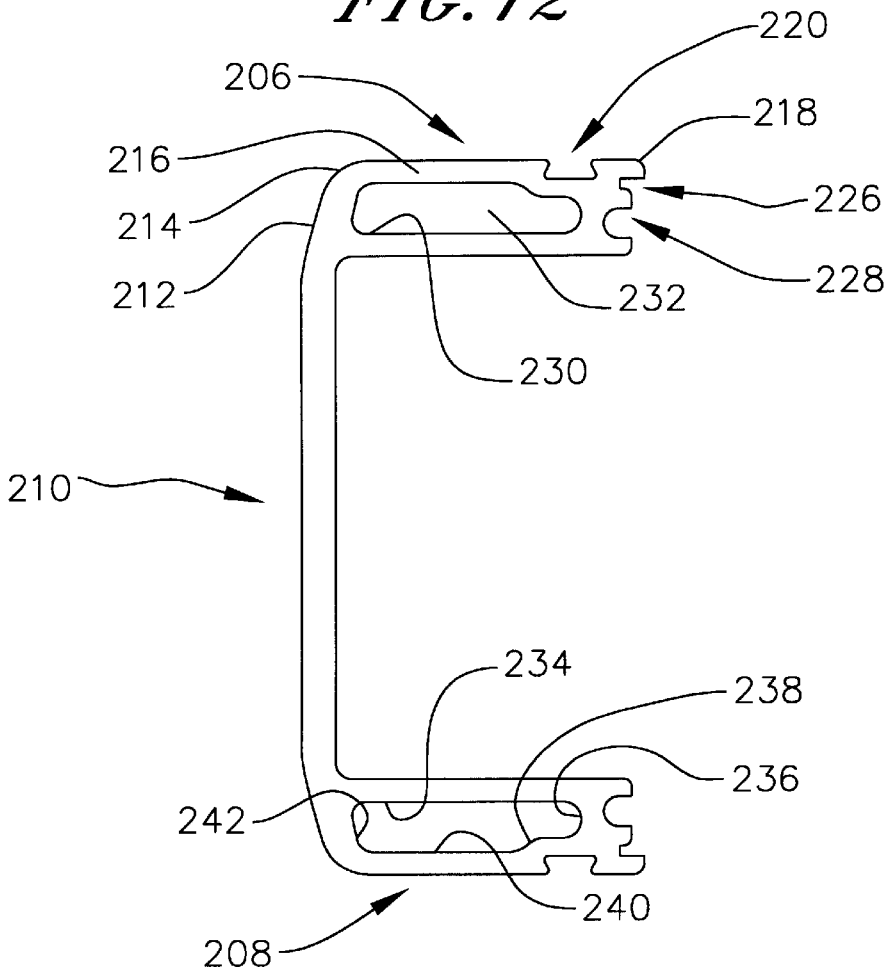
FIG. 12 is an end view substantially to scale of a profile of a center mullion element according to one aspect of the present invention.

A center mullion 204 (FIG. 12) includes first and second sidewalls 206 and 208 respectively, joined by a rearward wall 210. The first and second walls 206 and 208, respectively, are mirror images of each other, and only one will be described in detail. The rearward wall 210 is substantially flat and straight, both on the inside and outside of the center mullion. The rearward wall 210 joins the side walls on the outside through a slanted wall 212 terminating at a radius 214 curving into the flat wall 216 of the sidewall. The flat wall 216 terminates at a tip 218 and includes a double slanted retaining groove 220. The forward slanted wall of the groove 220 accepts a contact plate retaining clip 222 (FIG. 3) for retaining a center mullion contact plate 224 in a manner similar to that described above with respect to the retaining clip 114. The rearward slanted portion of the groove 220 accepts and removably retains a mullion cover 225 which in turn serves to mount fixtures or other hardware to the center mullion, as is known in the art. The center mullion also includes a centering groove 226 and a heater wire groove 228, having functions similar to those described above with respect to the frame rail 24.

The sidewalls of the mullion include internal walls 230 defining voids 232. The internal walls 230 include a first flat portion 234, and a radiused portion 236 joining a shoulder portion 238. A second flat portion 240 extends between the shoulder portion 238 and a slanted portion 242 through radiused corners, and the slanted wall 242 in turn joins the first flat wall 234 in a further radiused corner. The voids in the center mullion provide thermal insulation, lighter weight parts and extra surfaces for mounting equipment, and does not appreciably increase the wall thickness of the mullion.

The mullions may be mounted to upper and lower horizontally extending frame rails in a manner comparable to that with respect to preexisting mullion mounting arrangements. With the specific embodiment shown in FIG. 4, blind fasteners or pop rivets are preferably used to mount a pair of mullion mounting plates 250 to the rear facing surface 140 on the frame rails. For the top horizontally extending frame rail, pop rivets can pass through the mounting plate 250 and into the void 198, as well as another pop rivet through the mounting plate and into the void 202. In the bottom horizontal frame rail element, pop rivet can pass through the mounting plate 250 and into the void 198 and into the void 202. Four pop rivet can be used for each mounting plate. Fasteners are also used to mount the mullion to respective mullion plates.

The frame elements and mullions and the accompanying hardware are particularly suited for preassembly and prewiring. For example, each lineal element can be punched or mounted with the required hardware prior to being assembled into a unit with the other linear elements. For example, mullions can be prewired and preassembled with light fixtures, ballasts, wiring and the like. Frame elements can be pre-punched and mounted with the appropriate hardware prior to final assembly. Additionally, a slot can be formed behind the clip 114 in wall 108 of a frame element immediately above a mullion for permitting feeding through wires from the mullion into the raceway 104 and connection elsewhere. However, even with such a slot, heat transfer by convection is minimized in view of the enclosure formed by the mullion and the raceway. Sealant may be included if desired. Additionally, this assembly may be suitable for pre-assembly and shipping in a knocked-down form, as opposed to a full assembled form, as is typical with present assemblies.

Figure 6:
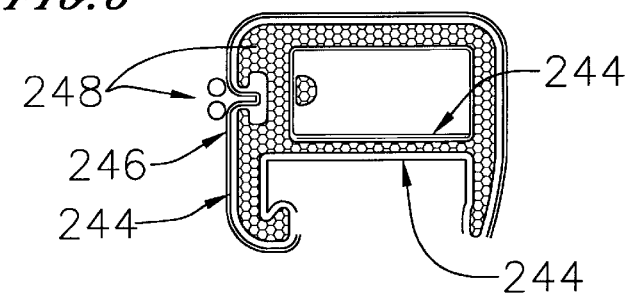
FIG. 6 shows a stacking arrangement for forming the pultruded door rail element.
Figure 7:
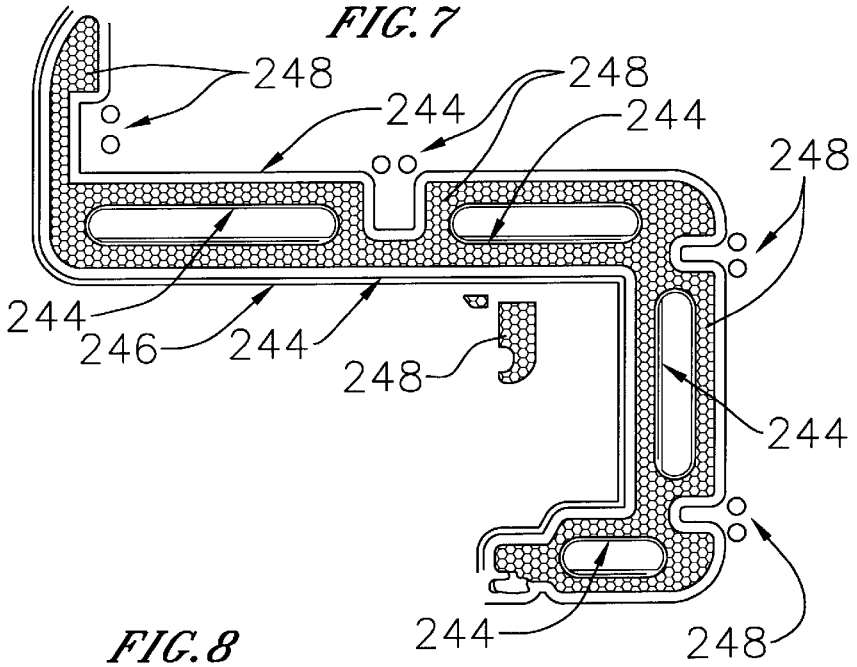
FIG. 7 shows the stack arrangement for preparing a pultruded frame rail element.
Figure 8:
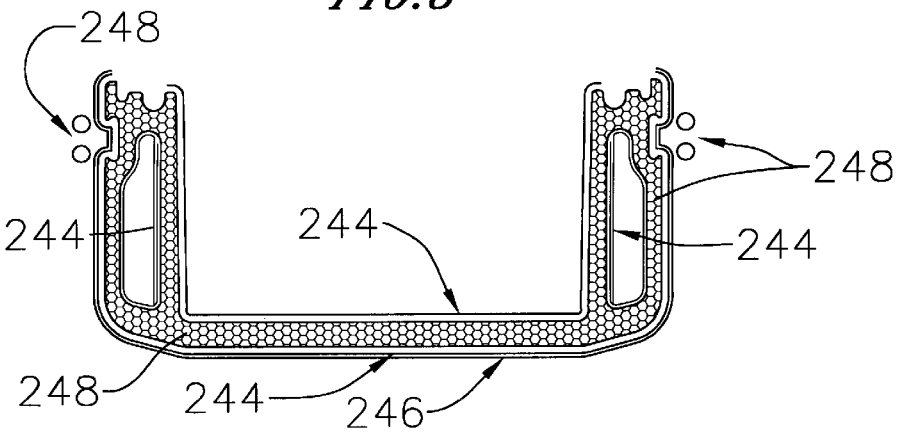
FIG. 8 shows a stacking arrangement for preparing a pultruded million element.
Figure 9:
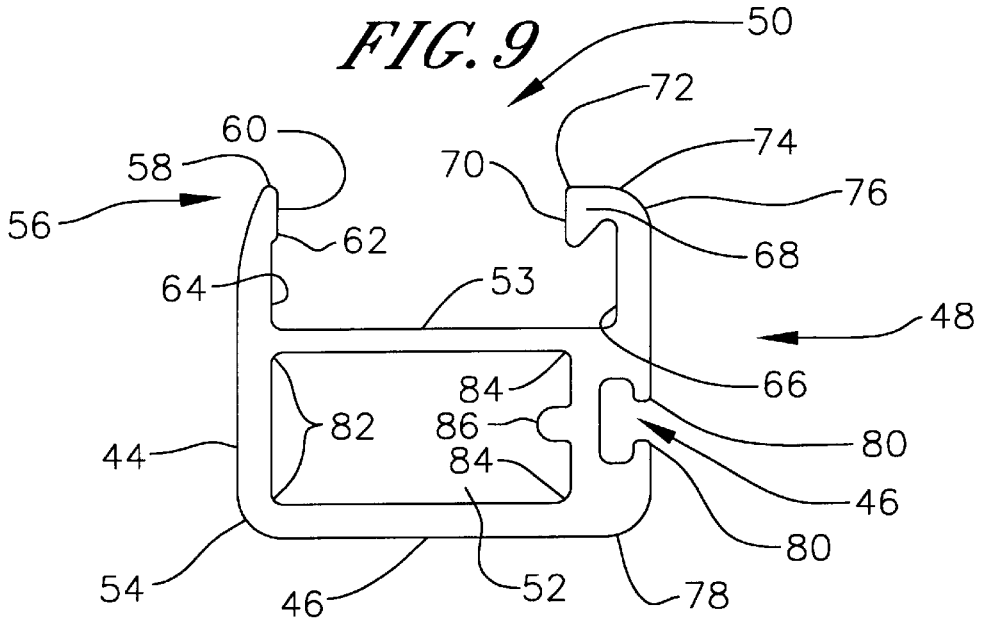
FIG. 9 is an end view substantially to scale of a profile of a door rail in accordance with one aspect of the present invention.

The pultrusion stacking arrangement for the door rail, frame rail, and mullion are shown in FIGS. 6–8, respectively. These stacking arrangements show the material placement for mats and roving conventional in pultrusion, and demonstrate how the rail and mullion profiles can be formed. The profiles can be made by Omega Pultrusions, Inc., using continuous strand Fiberglass mat from such suppliers as Owens-Corning, MicoFiber, PPG or Certainteed. The surface veil and continuous strand Fiberglass rovings can be formed in conventional manner as would be known to those skilled in the art. Fiberglass rovings can also be obtained from such companies as PPG and the others listed. Polyester resins can be obtained from Owens Corning, as well as the other companies listed, and Polyester Remay can likewise be obtained from Owens Corning and the other companies.

The stack up shown in FIGS. 6–8 are well understood to those skilled in the art. The profiles are formed from continuous strand fiberglass mat 244 a surface veil 246 is also included and the hexagonal designations in FIGS. 6–8 depict the continuous strand fiberglass rovings 248. The profiles are then formed using procedures known to those skilled in the art, such as those used by Omega Pultrusions Incorporated.

Exemplary dimensions demonstrating that these profiles can be produced in sizes comparable to existing door and frame rails are discussed below. For example, it is believed that the door and frame profiles fit within a circle of a diameter that would be the same as that for a Model 101 door and frame assembly presently manufactured by Anthony's Manufacturing Company, Inc. As a result, it is believed that doors and frames of the present design can be easily installed on cases or units for which doors and frames of the Model 101 design were installed. Beginning with the door rail, with all dimensions being given in inches as follows:

| Location | Dimension (Inch) |
|---|---|
| Width, from sideface 46 to tip 58 and 72 | 1.332 |
| Depth from forward face 44 to rearward face 48 | 1.576 |
| Forward bite surface | 0.18 |
| Rearward bite surface 7 | 0.21 |
| Thickness from forward face 44 to forward bite surface 60 | 0.140 |
| Forward face 44 to parallel inside surface 64 | 0.125 |
| Length of angle edge 62 | 0.015 |
| Spacing between bite surfaces | 1.125 |
| Thickness of internal wall 52 | 0.080 |
| Inside width of full hollow 52 | 0.595 |
| Depth of inside hollow | 1.146 |
| Height of ridge 86 | 0.023 + 0.009 or − 0.003 |
| Spacing of center of ridge 86 from adjacent wall | 0.298 |
| Depth of groove 42 | 0.18 |
| Thickness of shoulders 80 | 0.06 |
| Distance each shoulder 80 extends into opening of groove | 0.075 |
| Width of groove | 0.170 |
| Distance of uttermost shoulder 80 from sideface 86 | 0.365 |
| Height of inwardly facing surface 74 from interior wall | 0.532 |
| Small thickness of projection 68 | 0.125 |
| Radius of two edges 62 inner forward corner 82 and shoulders 80 | 0.015 |
| Radius of other corners 82 and 84, and bottoms of groove 42 | 0.060 |
| Radius of corners 54, 76 and 78 | 0.180 |
| All other radii of door rail | 0.030 |
| Radius of feathering at feathered tip 56 | 1.50 |
| Radius of tip 58 | 0.03 |

Exemplary Dimensions for the Frame Rail and End Mullion are as Follows

| Location | Dimension (Inch) |
|---|---|
| Width of decorator strip | 1.230 |
| Radius of feathering | 0.750 |
| Radius of tip of 118 | 0.04 |
| Thickness of decorator strip | 0.220 |
| Depth of groove 124 | 0.60 |
| Thickness of decorator wall between decorator face 116 and bottom of groove | 0.080 |
| Width of opening in retainer groove 124 | 0.288 |
| Height of each ridge 126 | 0.100 |
| Radius between 126 and outwardly facing surface 126 | 0.09 |

-continued

| Location | Dimension (Inch) |
|---|---|
| Overall thickness of sidewall | 0.400 |
| Thickness of first void | 0.240 |
| Depth of first void | 1.300 |
| Thickness of sidewall | 0.400 |
| Thickness of wall on each side of first void | 0.080 |
| Depth of second void | 1.00 |
| Width of second void | 0.240 |
| Distance from first void to second void | 0.500 |
| Distance from wall of groove 128 adjacent first void void to wall of groove 128 adjacent second void | 0.300 |
| Size of opening for groove 128 | 0.100 |
| Thickness of wall between groove 128 and surface 176 | 0.120 |
| Depth of the second void | 1.00 |
| Width of second void | 0.240 |
| Width of transverse wall from outwardly facing surface 126 to third side 108 | 2.010 |
| Width of third void | 0.905 |
| Depth of third void | 0.200 |
| Thickness of walls on each side of third void | 0.080 |
| Width of fourth void | 0.200 |
| Thickness of walls of each side four void | 0.080 |
| Void radius | |
| Full Radius of shoulders 126, 130, 146, etc. | 0.015 |
| Groove 144 center lein to center line | 1.280 |
| Distance from outwardly facing surface 126 to start of third void | 0.550 |
| Width of third void | 0.905 |
| Depth of fourth void | 0.490 |
| Start of fourth void from rearwardly facing surface 140 | 0.230 |
| Depth of fourth void | 0.490 |
| Radius of corners 128 and 142 | 0.19 |
| Distance from outwardly facing surface 126 to first center line of groove 144 | 0.363 |
| Width of tip 152 | 0.067 |
| Width of groove 158 | 0.040 |
| Distance tip 152 extends beyond surface 160 | 0.040 |
| Opening 154 | 0.113 |
| Radius of heater wire groove 180 | 0.121 |
| Outside radius of projection 178 | 0.130 |
| Width of heater wire opening | 0.106 |
| Depth of groove 112 from wall 184 to wall 182 | 0.100 |
| Distance from straight wall 184 to extension of base surface (wall 182 and opposite wall 174) for the contact plate projection | 0.047 |
| Distance from straight wall 184 to extreme tip of contact plate projections 178 (providing bias or slight feexing of contact plate) | 0.040 |
| Length of straight wall 184 | 0.062 |
| Base depth of contact plate projection 178 | 0.125 |
| Distance of heater wire groove center line from wall 174 | 0.260 |

For the Mullion Dimension

| Location | Dimension (Inch) |
|---|---|
| Depth of mullion from tip 218 to rearward wall 210 | 1.310 |
| Width from sidewall 206 to sidewall 208 | 2.740 |
| Wall thickness on each side of void | 0.080 |
| Width of void | 0.20 |
| Full depth of void | 0.87 |
| Start of slant wall 238 from full radius of void | 0.15 |
| Distance from start of slant wall to rearward surface 210 | 0.935 |
| Thickness of wall 210 | 0.130 |
| Internal radius of junction between sidewalls and rear wall 210 | 0.06 |
| Radius of corners 214 | 0.18 |
| Thickness of slanted wall 212 | 0.130 |
| Width of opening of heater wire groove | 0.109 |
| Distance tip 218 extends from top of heater wire groove | 0.050 |
| Center of heater wire groove to top of heater wire groove | 0.044 |
| Width of groove 226 | 0.045 |

Refrigerator door rails, frame rails and mullion pieces have been described which include voids for improved thermal protection against heat transfer, reduces or eliminates any need for heated rail elements and provides a material having a better dielectric property than aluminum. It is believed that the need for heated door rail elements for freezer units has been eliminated. The described structures also appear to eliminate the need for an encircling metal frame support for the door and the glass supported by the door, and provides a door and frame material having a pleasing aesthetic appearance. Use of voids within the wall thickness permit attachment of hardware without breaching the entire thickness of the wall such as the frame rail wall. The voids in the walls are relatively small but still provide suitable thermal insulation and structural rigidity, and integrity and strength. Adjacent voids in the frame rail provide for continuity and uniformity over the frame rail.

The transverse wall 102 and the contact plate projection 178 provide a front opening and accessible raceway 104 which provides for easier assembly of the frame assembly and hardware. During assembly of the frame, the frame does not need to be turned over to gain access to the raceway for installing wiring and other hardware. After assembly, the raceway is easily accessible simply by removing the contact plate clips and removing the contact plate. The contact plate is then easily reinstalled and held in place with the contact plate clips. If desired, a heater wire can but need not be placed in the heater wire groove 180 for minimizing the possibility of condensation on the contact plate. The configuration of the contact plate projection and the third wall 108 of the raceway facilitate easy assembly and servicing of the raceway and the contact plate.

These door and frame rails and mullion constructions provide for consolidated structures and reduce part counts while at the same time producing straight and reliable structures having small but strong edges. The high structural rigidity, strength and integrity are particularly suitable for swing doors having relatively high impact, torsion and flexing that typically occurs with heavy use. Additionally, the higher structural rigidity, strength and integrity of the door rail provide a higher glass bite on the glass pack, and a stronger and more reliable door construction. The small radii of these rails permits fine detail in the construction and reproducible results for low cost manufacturing.

The door rail provides an improved appearance having a low front-facing profile with minimal extension of the forward face 44 over the glass package. The small depth in the forward face of the door rail gives a small front face on the structure and contributes to the appearance of a flat front face to the glass door.

The materials used in the door rails provide light weight and easily handled pieces. The frame rail designs allow easy gang punching of top and bottom frame rails for insulation of hardware and easier manufacturing and assembly, as well as lower inventory. Overall costs of manufacturing are reduced over that for aluminum, and fewer assembly steps are required. The use of voids also reduces material costs.

The frame rails are assembled in a manner comparable to that currently used with aluminum frame rails.

The above description discloses the preferred embodiments of the present invention. However, various modifications can be made to the preferred embodiments without departing from the functions or results provided by the invention. Therefore, the invention is limited only by the claims appended here to.

I claim:

1. A frame assembly for supporting a door, the frame assembly comprising:

pultruded frame rail elements having a first leg and a second leg integral with each other, each of the first and second legs defining respective thicknesses and wherein each leg includes at least one internal wall defining a fully enclosed void within the thickness of the leg, and a third leg associated with the second leg such that a channel is defined between the third leg, the second leg and the first leg;

a contact plate extending from the first leg parallel to the second leg to the third leg, wherein the contact plate covers the channel; and electrical hardware located within the channel between the second leg and the contact plate.

2. A frame assembly for supporting a door, the frame assembly comprising:

pultruded frame rail elements having a first leg and second leg integral with each other and wherein each of the first and second legs have respective thicknesses and wherein at least one leg includes at least one internal wall defining a fully enclosed void within the thickness of the leg to define first and second spaced apart walls in the leg and the first wall includes a wall for extending adjacent a door; and a mounting element for engaging a connection with a door, the mounting element engaging the first wall of one leg of the frame rail element without passing completely through the second wall of the frame rail element and including a retainer for a door hold open device.

3. A frame assembly for supporting a door, the frame assembly comprising:

pultruded frame rail elements having a first leg and second leg integral with each other and wherein each of the first and second legs have respective thicknesses and wherein at least one leg includes at least one internal wall defining a fully enclosed void within the thickness of the leg to define first and second spaced apart walls in the leg; and a mounting element for engaging a connection with a door, the mounting element being riveted to the first wall of one leg of the frame rail element without passing completely through the second wall of the frame rail element.

4. A frame assembly for supporting a door, the frame assembly comprising:

pultruded frame rail elements having a first leg and second leg integral with each other and wherein each of the first and second legs have respective thicknesses and wherein at least one leg includes at least one internal wall defining a fully enclosed void within the thickness of the leg to define first and second spaced apart walls in the leg; and a hinge pin anchor for supporting a door for swinging movement relative to the frame, the hinge pin anchor engaging the first wall of one leg of the frame rail element without passing completely through the second wall of the frame rail element.

5. A frame assembly for supporting a door, the frame assembly comprising pultruded frame rail elements having a first leg and second leg integral with each other, wherein each of the first and second legs have respective thicknesses and wherein at least the first leg includes at least one internal wall defining a fully enclosed void within the thickness of the leg to define first and second spaced apart walls in the leg extending from a front portion of the frame to a rearward portion of the frame, and a mounting element for engaging a connection with a door, the mounting element engaging the first wall of the first leg of the frame rail element between the front portion and the rearward portion.

6. A frame assembly for supporting a door, the frame assembly comprising a plurality of pultruded frame rail elements connected together to form a frame assembly, wherein each frame element has a first leg and a second leg integral with each other and wherein each of the first and second legs have respective thicknesses and wherein each leg includes at least one internal wall defining a fully enclosed void within the thickness of the leg, wherein the second leg has integral with it a third leg parallel to the first leg and defining with the first and second legs a channel for accepting hardware, a contact plate extending across the channel and covering the channel from the third leg to the first leg, and a contact plate retaining clip retaining the contact plate in place.

7. The frame assembly of claim 6 wherein the first leg includes a contact plate projection having a plate receiving groove, wherein the contact plate has a first edge engaging the plate receiving groove, and a second edge positioned adjacent the third leg, and wherein the clip engages the second edge of the contact plate.

8. The frame assembly of claim 6 wherein at least one of the first and third legs includes a surface biasing the contact plate against the retaining clip.

9. The frame assembly of claim 6 wherein the first leg includes a projection having a channel receiving one end of the contact plate and wherein the projection is formed so as to bias the contact plate.

10. A frame assembly for supporting a door in an opening so that the door can provide a closure when installed in the frame, the opening having a rear portion and being defined by a wall having an outwardly facing portion, the frame assembly comprising:

top, bottom, left and right pultruded frame rail elements assembled together to form a frame for supporting the door, each frame rail element having a first leg and second leg integral with each other, and a flange on one portion of the first leg adapted to extend over the outwardly facing portion of the wall, wherein the first leg is adapted to extend from the outwardly facing portion of the wall in a direction toward the rear of the opening, and the second leg extends substantially perpendicularly from the first leg, and a third leg extending from the second leg toward the outwardly facing portion to define with part of the first leg and the second leg a cavity in the frame element, wherein each of the first and second legs have respective thicknesses and wherein at least one of the first and second legs includes at least one internal wall defining a fully enclosed void within the thickness of the leg to define first and second spaced apart walls in the leg, and a mounting element adapted to engage a connection with a door, the mounting element engaging the first wall of one leg of one of the frame rail elements without passing completely through the second wall of the frame rail element.

11. The frame assembly of claim 10 wherein the frame rail elements are assembled into a rectangular frame, wherein the adjacent flanges for extending over the outwardly facing portion of the wall on adjacent frame rail elements are connected together by corner keys.

12. The frame assembly of claim 11 wherein the flanges include a front surface and a rearward surface and the rearward surface includes a passageway into which the corner keys extend holding adjacent frame rails together.

13. The frame assembly of claim 12 wherein each frame rail includes a further surface engaging a corner key.

14. The frame assembly of claim 13 where in the further surface is formed on the second leg and wherein the corner key is fastened to the further surface.

15. The frame assembly of claim 12 wherein the corner keys extending into the passageway engage the passageway through an interference fit.

16. The frame assembly of claim 10 wherein the voids in the first leg and the thickness of the walls defining the voids have substantially the same dimensions from a point closer to the forward portion of the first leg to a point adjacent a rearward portion of the first leg.

17. The frame assembly of claim 10 further including hinge elements for supporting a door wherein the hinge elements are mounted to at least one of the frame rails by a fastener passing through the first wall of the one leg without passing into the second wall of the first leg.

18. The frame assembly of claim 10 wherein the mounting element passes through an aperture in the top frame rail element which faces the bottom frame rail element.

19. The frame assembly of claim 10 wherein both of the first and second legs include an internal wall defining a fully enclosed void within the thickness of the leg.

20. A method of assembling a frame for supporting a door, the method comprising the steps of assembling first and second frame elements wherein each of the first and second frame elements include a first leg and second leg integral with each other and wherein each of the first and second legs have respective thicknesses and wherein at least one leg includes at least one internal wall defining an at least partially enclosed void within the thickness of the leg to define first and second spaced apart walls in the leg, and mounting a joining element to the first wall of one leg of each of the frame rail elements without passing completely through the second wall of the respective frame rail elements such that adjacent ends of each of the first and second frame elements are held by the joining elements to form a corner of the frame elements.

21. A frame assembly for supporting a door, the frame assembly comprising:

top, bottom and side pultruded frame rail elements having a first leg and a second leg integral with each other and wherein each of the first and second legs have respective thicknesses and wherein each leg includes at least one internal wall defining a fully enclosed void within the thickness of the leg, the internal wall including first and second internal wall portions facing one another, the first internal wall portion having an aperture formed therein and the corresponding area of the second internal wall portion being free of apertures, the second leg including a third leg defining a channel between the third leg, the second leg and the first leg for accepting hardware;

wherein the aperture of the top frame rail element faces upwardly and the aperture of the bottom frame rail element faces downwardly.

22. The frame assembly of claim 21, wherein the at least one internal wall defining a fully enclosed void comprises first and second internal walls respectively defining first and second voids oriented in the same direction.

23. The frame assembly of claim 21, wherein the void has a length and a width wherein the length of the void is more than twice the width.

24. The frame assembly of claim 23, wherein the length of the void is approximately four times the width of the void.

25. The frame assembly of claim 21, wherein the void has a length and a width wherein the width is less than 1.0 inch.

26. A frame assembly for supporting a door, the frame assembly comprising:

top, bottom and side pultruded frame rail elements having a first leg and a second leg integral with each other and wherein each of the first and second legs have respective thicknesses and wherein each leg includes first and second internal walls respectively defining first and second fully enclosed voids oriented in the same direction within the thickness of the leg, the internal walls each including first and second internal wall portions facing one another, the first internal wall portions having respective apertures formed therein and the corresponding area of the second internal wall portions being free of apertures, the aperture of the top frame rail element facing upwardly and the aperture of the bottom frame rail element facing downwardly; and a mounting plate in one of the first and second void, wherein the first leg includes a first wall adjacent a door to be mounted in the frame assembly, and wherein the mounting plate is fastened in the void to the first wall.

27. The frame assembly of claim 26, wherein the mounting plate is fastened to the first wall with blind fasteners.

* * * * *